United States Patent [19]

Stancati et al.

[11] 4,055,929

[45] Nov. 1, 1977

[54] THREADED ANCHOR

[75] Inventors: Nicholas F. Stancati, Basking Ridge; Peter Garner, Chatham, both of N.J.

[73] Assignee: Acta Limited, Manville, N.J.

[21] Appl. No.: 730,817

[22] Filed: Oct. 8, 1976

[51] Int. Cl.[2] ..... E04B 1/41

[52] U.S. Cl. ..... 52/705; 85/32 V; 151/41.7

[58] Field of Search ..... 113/116 HA, 116 HH, 113/116 UT; 52/705, 708, 704, 617, 679, 707; 85/32 V, 32 K; 151/41.7

[56] References Cited

U.S. PATENT DOCUMENTS

| | | | |
|---|---|---|---|
| 991,517 | 5/1911 | Kennedy | 85/32 K |
| 1,531,754 | 3/1925 | Palmer | 52/704 X |
| 1,627,554 | 5/1927 | Fishel et al. | 52/705 X |
| 2,560,951 | 7/1951 | Henderson et al. | 52/704 X |
| 3,443,351 | 5/1969 | Kumazawa | 52/704 |
| 3,877,341 | 4/1975 | Grimm et al. | 151/41.7 |
| 3,962,843 | 6/1976 | King, Jr. | 151/41.7 |
| 3,982,363 | 9/1976 | Dorris | 85/32 K |

FOREIGN PATENT DOCUMENTS

| | | | |
|---|---|---|---|
| 130,635 | 12/1948 | Australia | 85/32 V |
| 131,879 | 6/1907 | Germany | 52/705 |
| 259,039 | 10/1911 | Germany | 85/32 K |
| 2,314,168 | 10/1973 | Germany | 151/41.7 |

*Primary Examiner*—Leslie Braun
*Attorney, Agent, or Firm*—Anthony J. Casella; Joseph A. Calvaruso

[57] ABSTRACT

A threaded anchor for embedding in a cementious material comprising a unitary member of generally cylindrical configuration, which is interiorally threaded and open at one end. The other end thereof is closed by a base portion of greater size than the diameter of the cylindrical member, said base portion being disposed perpendicular to the longitudinal axis of the cylindrical member. On the exterior surface of the cylindrical member are a plurality of radial flanges, which extend along the length of the cylindrical member, and are attached to the base portion.

The threaded anchor is preferably formed from a single sheet of metal. This sheet is fed into a drawing device, whereon the sheet is drawn into a cup shaped member having a closed end. The cup shaped member is placed over a mandrel and the exterior surface of the member is then pinched with means of shorter length than the length of the cup shaped member to form radial flanges on the exterior of the cup shaped member, and a flange at the bottom of the cup shaped member to which the exterior surface flanges are attached. The threads are then formed on the inner surface of the cup shaped member.

1 Claim, 4 Drawing Figures

THREADED ANCHOR

BACKGROUND OF THE INVENTION

In the construction industry, when concrete is used as a structure, or as a part of a structure, it is often necessary that means be provided for the secure fastening of objects, such as cabling racks and utility walls, to the concrete. This is commonly achieved by casting threaded anchors into the concrete at desired locations. The objects are then fastened to the anchor by means of a bolt.

Anchors in use today are usually molded from plastic or cast from zinc. The anchors, both plastic and zinc, are generally comprised of a tapered cylindircal member, having flanges extending longitudinally along the exterior surface of the cylinder. The purpose of the tapered configuration is to inhibit the anchor from being pulled out of the concrete when a tensile force is applied. The flanges prevent the anchor from turning in the concrete when a torque is applied.

The existing anchors, however, have several shortcomings. One shortcoming is that their configuration provides a relatively small pullout area of taper, and as a result there is only a limited amount of tensile force resistance.

Another shortcoming relates to the inherent weakness of the material used to manufacture the anchors (e.g. zinc or plastic). Because the bolts, which are used to fasten objects to the anchor, are usually made of galvanized steel, the bolt is harder and coarser than the anchor. Consequently, when the bolt is screwed into the anchor the threads of the anchor are often stripped or destroyed so that the fastening is not structurally sound.

In view of the above it is an object of the subject invention to provide a new and improved configuration of threaded anchor which provides greater tensile and torque resistance than obtained by the prior art devices.

It is another object of the subject invention to provide a method of constructing a threading anchor which is very economical, and also provides a structurally sound fastening means.

SUMMARY OF THE INVENTION

The subject invention relates to a new and improved threaded anchor for embedding in a concrete structure. The anchor is preferably constructed from a single square sheet of forming metal, such as steel, using conventional machine tools. The subject anchor comprises a unitary, elongated member of generally cylindrical configuration, having a constant diameter. The inner surface of the cylindrical member is threaded. One end of the cylindrical member is open while the other end is closed by a base portion of greater size than the diameter of the cylindrical member. The base portion is disposed perpendicular to the longitudinal axis of the cylindrical member. Radially emanating from the exterior surface of the cylindrical member, and preferably formed unitary therewith, are four flanges, generally rectangular in configuration, which are at right angles to each other, and parallel to the longitudinal axis of the cylindrical member. These flanges are attached to the base portion.

The flanges function to prevent the embedded anchor from turning when a torque is applied. The base portion prevents the embedded anchor from being pulled out of the concrete structure when a tensile force is applied.

As has been indicated, the subject anchor is preferably formed from a single sheet of metal. This sheet is fed into a drawing device whereon the sheet is drawn into a cup shaped member having a closed end. The cup shaped member is then placed over a mandrel and a four-jaw arrangement, the jaws of which have a length shorter than the length of the cup shaped member, pinch the exterior surface of the cup shaped member and simultaneously form radial flanges on the exterior surface of the cup shaped member, and a flange or base portion at the bottom of the cup shaped member. If the mandrel is threaded, threads are formed on the inner surface of the cup shaped member as the four-jaw arrangement pinches it. If the mandrel is smooth the threads may be rolled onto the inner surface of the cup shaped member by a hydroforming technique. The threads may also be formed by a tapping technique.

DESCRIPTION OF THE PREFERRED EMBODIMENT

Figure 1:
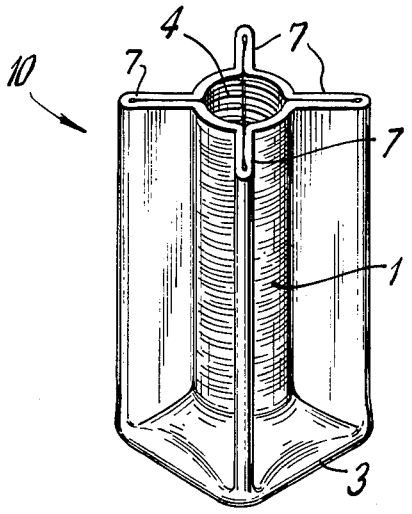
FIG. 1 is an isometric view of the threaded anchor of the subject invention.

Referring to FIG. 1, the threaded anchor 10 of the subject invention has a unitary elongated member 1 of generally cylindrical configuration, having a constant diameter. The interior surface of the cylindrical member 1 is threaded. One end 4 of the cylindrical member 1 is open, while the other is closed by a square shaped base portion 3, which is of greater size than the diameter of the cylindrical member 1. This base portion 3 is disposed perpendicular to the longitudinal axis of the cylindrical member 1.

Radially emanating from the exterior surface of the cylindrical member 1, and unitary therewith, are four flanges 7, generally rectangular in configuration. These flanges 7 extend the length of the cylindrical member 1, and are attached to the square shaped base portion 3. The flanges 7 are at right angles to each other, and parallel to the longitudinal axis of the cylindrical member 1.

As is clearly shown in the figures, the square shaped base portion 3 is larger than the diameter of the cylindrical member. Hence, portions of the base 3 are not covered by the cylindrical member 1. As a result, when the threaded anchor 10 is cast in the concrete, the concrete surrounds the base 3. In this way it forms a structural connection for preventing the anchor 10 from being pulled from the concrete. The fact that the base portion 3 is unitary with the cylindrical member 1 gives additional tensile strength to the anchor 10.

The flanges 7 function to prevent the embedded anchor 10 from turning when a torque is applied. As shown in the figures the flanges 7 are generally rectangular in configuration and are preferably disposed perpendicular to the longitudinal axis of the cylindrical member 1. However, the flanges 7 may also have a different configuration and may be disposed at an angle. In addition, while there are four flanges depicted in the figures, any number greater than one would be sufficient to provide the desired result. It should be noted that the flanges 7, as is the square shaped base portion 3, are unitary with the cylindrical member 1 thus giving the anchor 10 additional strength against torque.

The threaded anchor 10 of the subject invention is preferably made from a single sheet of metal, using standard machine tools. Twenty gauge cold rolled steel, aluminum keel grade has been found to be of good quality, i.e., sufficiently strong to overcome any stripping problem that a galvanized bolt may present, and yet sufficiently flexible to be formed into the threaded anchor. It is also strong enough to withstand high tensile force without distortion. Preferably the thickness of the sheet of metal used may be on the order of 0.050 inches.

The first step in the manufacture of the threaded anchor is to feed a square shaped strip of the cold rolled steel into a drawing device, comprising a punch and a die, which draws a cup shaped member, of generally cylindrical configuration, having a closed end. After this member is trimmed it is placed over a mandrel, whereon a four-jaw arrangement, each jaw of which has a length less than the length of the cup shaped member, pinches on the cup shaped member, from its open end to an interior portion, thereby simultaneously forming the cylindrically shaped member 1, the four radial flanges 7, and the square shaped base portion 3.

It should be noted that as a result of the drawing and compression processes the thickness of the metal is reduced only by about .005 inches. As a result the anchor is generally uniform and does not have areas of lesser strength which could cause distortion when forces are applied.

Figure 2:
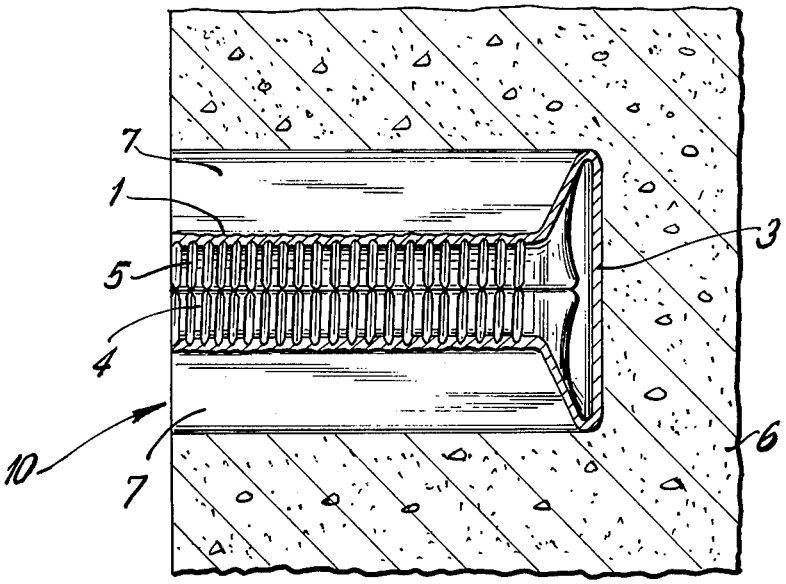
FIG. 2 is a cross-sectional view of the subject threaded anchor as embedded in concrete, cut along line 2—2 of FIG. 1.

If the mandrel is threaded, the thread design is formed within the anchor 10 during the pinching or compression by the four-jaw arrangement. In this way the outer surface of the cylindrical member 1 is displaced inwardly, thus creating serrations along the exterior surface of the cylindrical member 1. FIG. 2 is a cross-sectional view of an anchor 10 embedded in concrete, the threads 5 of which have been formed by the four-jaw arrangement. When the threads 5 are formed in this way, additional tensile strength is provided to the anchor because the concrete accumulates in the serrations of the cylindrical member 1, thereby making it more difficult for the anchor 10 to be extracted.

Figure 3:
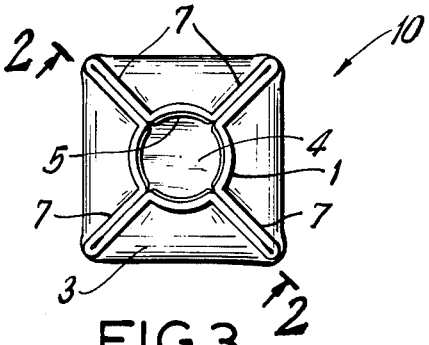
FIG. 3 is a top view of the threaded anchor of the subject invention.
Figure 4:
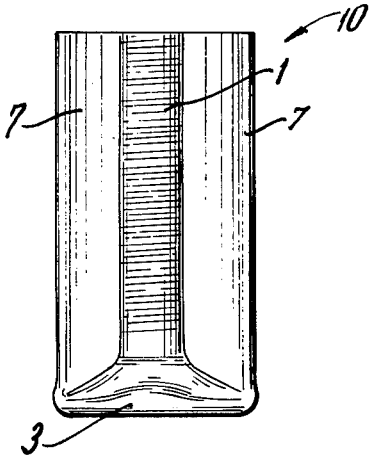
FIG. 4 is an elevational view of the threaded anchor of the subject invention.

If the mandrel is smooth, an additional step is required to form the threads. This may be done by rolling the threads onto the inner surface of the cylindrical member 1 by using a hydroforming technique. The anchor 10 of FIGS. 1, 3, and 4 have been formed in this way. When hydroforming is used the inner surface of the cylindrical member 1 is displaced outwardly.

Another method of forming the threads onto the subject anchor, though not preferable, is by using a tapping technique. When this method is used the inner surface of the cylindrical member 1 is cut to form the threads.

In summary, the subject invention provides a new and improved threaded anchor which provides greater tensile and torque resistance than obtained by the prior art devices. The subject invention also provides a method of manufacturing a threaded anchor very economically using standard machine tools.

The anchor of the subject invention is constructed from a single sheet of metal, giving it unitary construction. Because of the method of manufacturing the anchor, a high quality steel may be used. Hence, the problems of stripping and distortion which exists in the prior art are overcome. In addition, it is clear that because of its unitary construction and configuration, which employs a square base which is larger than the cylindrical member that the subject anchor provides much more strength against tensile forces than the mere tapered configuration of the prior art.

While there have been described herein what are at present considered preferred embodiments of the subject anchor and a preferred method of producing same, it will be obvious to those skilled in the art that modifications and changes may be made therein without departing from the essence of the invention. It is therefore understood that the exemplary embodiments are illustrative and not restrictive of the invention, the scope of which is defined in the appended claims, and that all modifications that come within the meaning and range of equivalency of the claims are intended to be included therein.

What is claimed is:

1. A heavy duty threaded anchor for embedding in a cementious material, constructed from a single square sheet of metal comprising a unitary elongated member of generally cylindrical configuration, said cylindrical member being open at one end and interiorly threaded along its length, the other end of said cylindrical member being closed by a pyramid shaped base member having a substantially square portion which is greater in size than the diameter of the cylindrical member and four inclined surfaces extending from said square portion to the cylindrical member, said base member being perpendicular to the longitudinal axis of the cylindrical member and unitary with said cylindrical member; and four radial, substantially rectangular flange members, said flange members being unitary with said cylindrical member and extending along the entire length of the outer surface of the cylindrical member, said flange members being unitary with the base member and disposed at right angles to each other.

* * * * *